US006336222B1

(12) United States Patent
Ware

(10) Patent No.: US 6,336,222 B1
(45) Date of Patent: Jan. 8, 2002

(54) COMBINATION VEST AND BACKPACK

(76) Inventor: Gregory C. Ware, 101 Mill Stone Cove, Crestview, FL (US) 32539

( * ) Notice: Subject to any disclaimer, the term of this patent is extended or adjusted under 35 U.S.C. 154(b) by 0 days.

(21) Appl. No.: 09/677,016

(22) Filed: Sep. 29, 2000

(51) Int. Cl.[7] ..... A41D 1/00
(52) U.S. Cl. ..... 2/94; 2/102
(58) Field of Search ..... 2/94, 102, 108, 2/85, 93; 224/151, 205

(56) References Cited

U.S. PATENT DOCUMENTS 2,248,455 A * 7/1941 Freund ..... 2/108
2,620,479 A * 12/1952 Buck ..... 2/94
2,992,433 A * 7/1961 Roberge
4,068,314 A * 1/1978 Yellen et al.
4,502,155 A * 3/1985 Itoi
4,601,067 A * 7/1986 Buonassissi
4,637,075 A * 1/1987 Ingrisano et al.
4,669,127 A * 6/1987 Swanson ..... 2/94
4,700,409 A * 10/1987 De Lott ..... 2/94
4,815,146 A * 3/1989 Theewis et al. ..... 2/94
4,949,401 A * 8/1990 Kimsey, Jr. ..... 2/102
4,998,654 A * 3/1991 Bruzek ..... 2/102 X
D316,172 S 4/1991 Hanson
5,014,359 A * 5/1991 Hanson ..... 2/94
5,070,436 A 12/1991 Alexander et al.
5,695,853 A 12/1997 Billingsley et al.
5,797,143 A 8/1998 Buxton
5,909,802 A 6/1999 Puco et al.

OTHER PUBLICATIONS

Bike Nashbar—Winter 1996–1997, Catalog 118, p. 65 Nathan Reflective Biking Vest; (B) Safety Vest Dec. 1996.*

* cited by examiner

*Primary Examiner*—Gloria M. Hale

(57) ABSTRACT

A combination vest and backpack for combining a reflective vest for high visibility and a backpack. The combination vest and backpack includes a vest. The vest has a chest portion, a pair of side portions, a back portion and a pair of shoulder straps. The chest portion is divided into a left side and right side. The back portion comprises an inside panel and an outer panel coupled together such that a space is defined between the inside and outer panels. The outer panel has at least one opening therein extending into the space. The front and back side portions each has an outer surface comprising a generally reflective material. A closing means selectively closes of the opening. A fastening means releasably fastens the left side of the chest portion to the right side.

15 Claims, 2 Drawing Sheets

COMBINATION VEST AND BACKPACK

BACKGROUND OF THE INVENTION

1. Field of the Invention

The present invention relates to vest devices and more particularly pertains to a new combination vest and backpack for combining a reflective vest for high visibility and a backpack.

2. Description of the Prior Art

The use of vest devices is known in the prior art. More specifically, vest devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,014,359; 5,695,853; 5,797,143; 5,909,802; U.S. Des. Patent No. 316,172; and U.S. Pat. No. 5,070,436.

While these devices fulfill their respective, particular objectives and requirements, the aforementioned patents do not disclose a new combination vest and backpack. The inventive device includes a vest. The vest has a chest portion, a pair of side portions, a back portion and a pair of shoulder straps. The chest portion is divided into a left side and right side. The back portion comprises an inside panel and an outer panel coupled together such that a space is defined between the inside and outer panels. The outer panel has at least one opening therein extending into the space. The front and back side portions each has an outer surface comprising a generally reflective material. A closing means selectively closes of the opening. A fastening means releasably fastens the left side of the chest portion to the right side.

In these respects, the combination vest and backpack according to the present invention substantially departs from the conventional concepts and designs of the prior art, and in so doing provides an apparatus primarily developed for the purpose of combining a reflective vest for high visibility and a backpack.

SUMMARY OF THE INVENTION

In view of the foregoing disadvantages inherent in the known types of vest devices now present in the prior art, the present invention provides a new combination vest and backpack construction wherein the same can be utilized for combining a reflective vest for high visibility and a backpack.

The general purpose of the present invention, which will be described subsequently in greater detail, is to provide a new combination vest and backpack apparatus and method which has many of the advantages of the vest devices mentioned heretofore and many novel features that result in a new combination vest and backpack which is not anticipated, rendered obvious, suggested. or even implied by any of the prior art vest devices, either alone or in any combination thereof.

To attain this, the present invention generally comprises a vest. The vest has a chest portion, a pair of side portions, a back portion and a pair of shoulder straps. The chest portion is divided into a left side and right side. The back portion comprises an inside panel and an outer panel coupled together such that a space is defined between the inside and outer panels. The outer panel has at least one opening therein extending into the space. The front and back side portions each has an outer surface comprising a generally reflective material. A closing means selectively closes of the opening. A fastening means releasably fastens the left side of the chest portion to the right side.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination vest and backpack apparatus and method which has many of the advantages of the vest devices mentioned heretofore and many novel features that result in a new combination vest and backpack which is not anticipated, rendered obvious, suggested, or even implied by any of the prior art vest devices, either alone or in any combination thereof.

It is another object of the present invention to provide a new combination vest and backpack which may be easily and efficiently manufactured and marketed.

It is a further object of the present invention to provide a new combination vest and backpack which is of a durable and reliable construction.

An even further object of the present invention is to provide a new combination vest and backpack which is susceptible of a low cost of manufacture with regard to both materials and labor, and which accordingly is then susceptible of low prices of sale to the consuming public, thereby making such combination vest and backpack economically available to the buying public.

Still yet another object of the present invention is to provide a new combination vest and backpack which provides in the apparatuses and methods of the prior art some of the advantages thereof, while simultaneously overcoming some of the disadvantages normally associated therewith.

Still another object of the present invention is to provide a new combination vest and backpack for combining a reflective vest for high visibility and a backpack.

Yet another object of the present invention is to provide a new combination vest and backpack which includes a vest. The vest has a chest portion, a pair of side portions, a back portion and a pair of shoulder straps. The chest portion is divided into a left side and right side. The back portion comprises an inside panel and an outer panel coupled together such that a space is defined between the inside and outer panels. The outer panel has at least one opening therein extending into the space. The front and back side portions each has an outer surface comprising a generally reflective material. A closing means selectively closes of the opening. A fastening means releasably fastens the left side of the chest portion to the right side.

Still yet another object of the present invention is to provide a new combination vest and backpack that may be worn by a bicyclist for providing high visibility for the bicyclist and a convenient means for carrying items.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
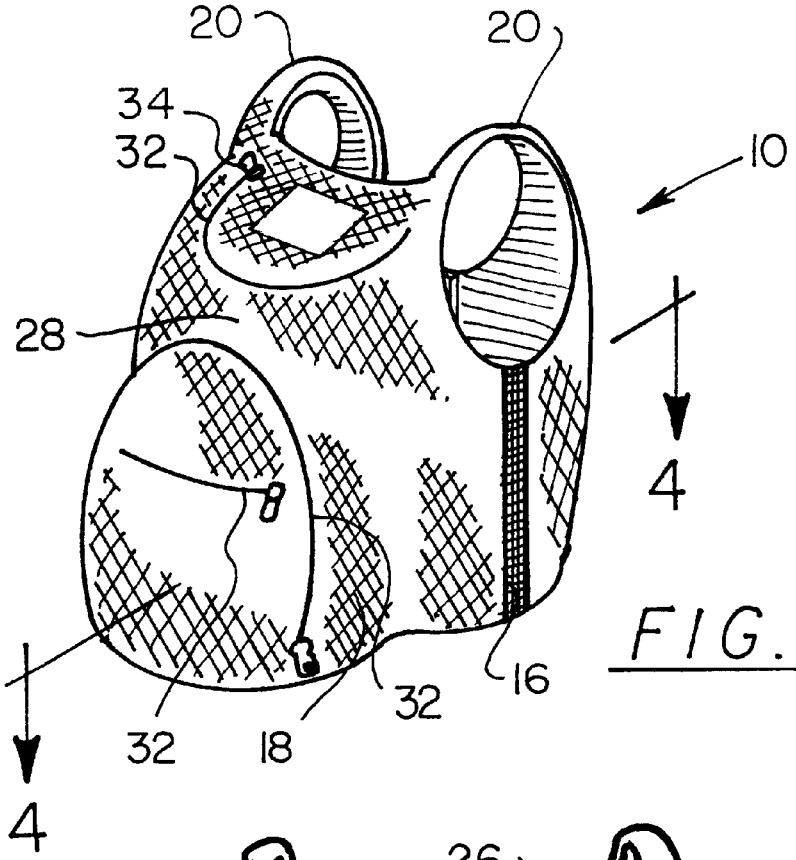
FIG. 1 is a schematic perspective back view of a new combination vest and backpack according to the present invention.
Figure 2:
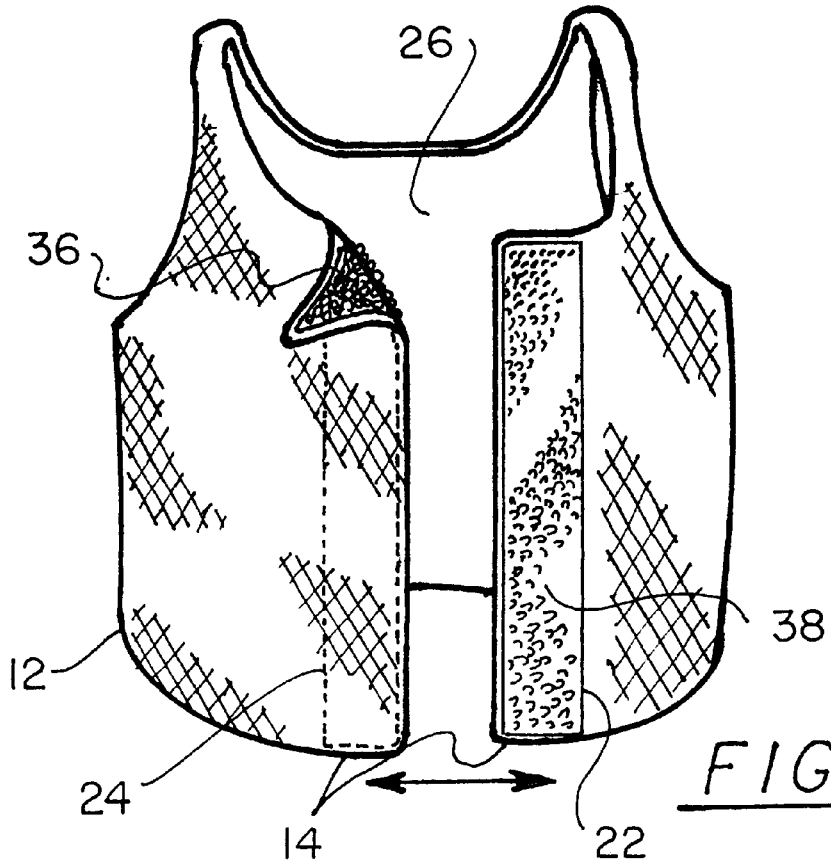
FIG. 2 is a schematic front view of the present invention.
Figure 3:
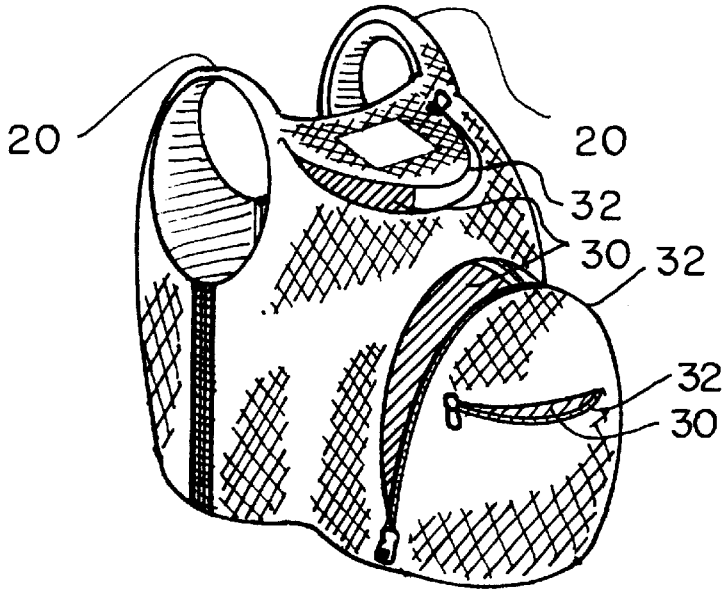
FIG. 3 is a schematic perspective view of the present invention.
Figure 4:
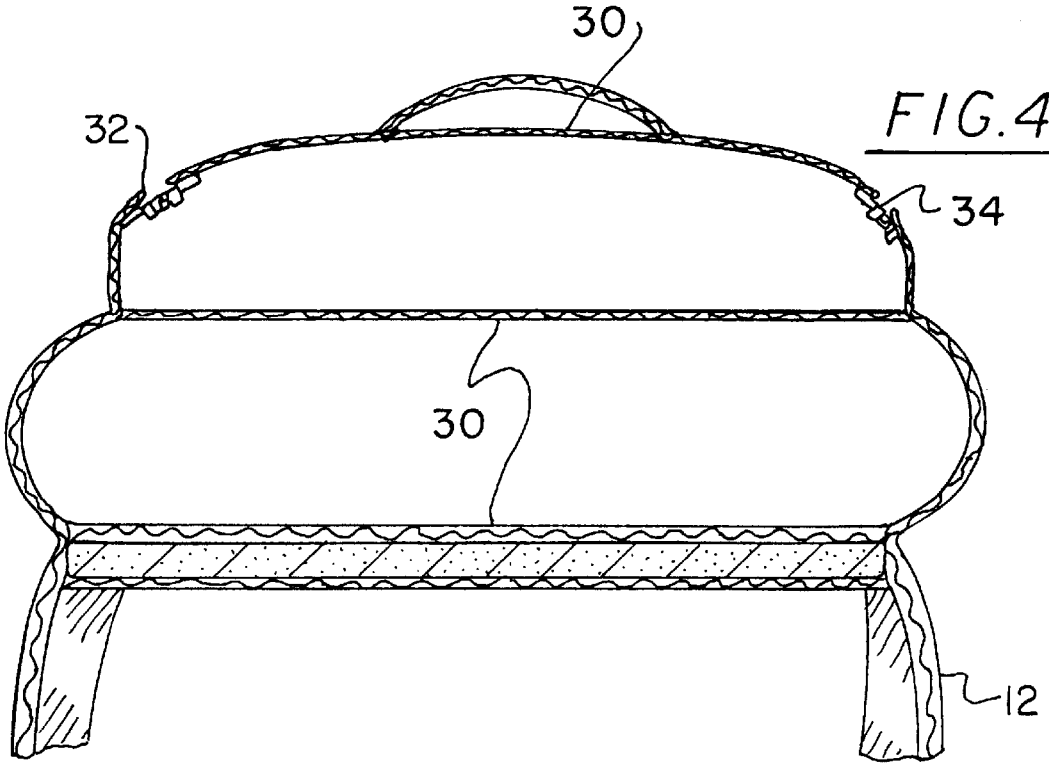
FIG. 4 is a schematic cross-sectional view taken along line 4—4 of the present invention.

With reference now to the drawings, and in particular to FIGS. 1 through 4 thereof, a new combination vest and backpack embodying the principles and concepts of the present invention and generally designated by the reference numeral 10 will be described.

As best illustrated in FIGS. 1 through 4, the combination vest and backpack 10 generally comprises a vest 12. The vest 12 has a chest portion 14, a pair of side portions 16, a back portion 18 and a pair of shoulder straps 20. The chest portion 14 is divided into a left side 22 and right side 24. The back portion 18 comprises an inside panel 26 and an outer panel 28 coupled together such that a space is defined between the inside 26 and outer 28 panels. A plurality of intermediate walls 30 is securely attached to an inner surface of the outer panel 28 such that the space is divided into a plurality of compartments. The outer panel 28 has a plurality of openings 32 therein. Each of the openings 32 is elongate and extends into one of the compartments. Each of the side portions 16 comprises a resiliently flexible material to allow fitting for a variety of sizes. The chest 14 and back 18 portions each has an outer surface comprising a generally reflective material. Ideally the outer surface is colored green and orange.

A plurality of closing means selectively closes each of the openings. Each of the closing means is securely attached to the outer panel and positioned over one of the openings 32. Each of the closing means ideally comprises a zipper member 34.

A fastening means releasably fastens the left side 22 of the chest portion to the right side. The fastening means comprises a hook and loop fastening means comprising a hook portion 36 and loop portion 38. The hook portion 36 is securely attached to an inside surface of the right side 24. The loop portion 38 is securely attached to an outer surface of the left side 22.

In use, the vest 12 is worn as a conventional vest. The back of the vest has openings therein for entrance into the compartments. The back of the vest generally forms a backpack portion of the device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vest and backpack combination device, comprising:

a vest having a chest portion, a pair of side portions, a back portion and a pair of shoulder straps, said chest portion being divided into a left side and right side, said back portion comprising an inner panel and an outer panel coupled together such that a space is defined between said inside and outer panels, said outer panel having at least one opening therein extending into said space, said front and back side portions each having an outer surface being formed of a generally reflective material;

a closing means for selectively closing of said opening;

a fastening means for releasably fastening said left side of said chest portion to said right side;

wherein said fastening means comprises a hook and loop fastening means comprising a hook portion and loop portion, said hook portion being securely attached to an inside surface of said right side, said loop portion being securely attached to an outer surface of said left side.

2. The vest and backpack combination device as in claim 1, wherein said vest further comprises:

a plurality of intermediate walls being securely attached to an inner surface of said outer panel such that said space is divided into a plurality of compartments, said outer panel having a plurality of openings therein, each of said openings being elongate and extending into one of said compartments; and a plurality of closing means for selectively closing each of said openings.

3. The vest and backpack combination device as in claim 2, wherein said vest further comprises:

each of said side portions comprising a resiliently flexible material.

4. The vest and backpack combination device as in claim 1, wherein said vest further comprises:

each of said side portions comprising a resiliently flexible material.

5. The vest and backpack combination device as in claim 4, wherein said closing means comprises a zipper member.

6. A vest and backpack combination device, comprising:

a vest having a chest portion, a pair of side portions, a back portion and a pair of shoulder straps, said chest portion being divided into a left side and right side, said back portion comprising an inner panel and an outer panel coupled together such that a space is defined between said inner and outer panels, a plurality of intermediate walls being securely attached to an inner surface of said outer panel such that said space is divided into a plurality of compartments, said outer panel having a plurality of openings therein, each of said openings being elongate and extending into one of said compartments, each of said side portions comprising a resiliently flexible material, said chest and back portions each having an outer surface being formed of a generally reflective material;

a plurality of closing means for selectively closing each of said openings, each of said closing means being securely attached to said outer panel and positioned over one of said openings, each of said closing means comprising a zipper member;

a fastening means for releasably fastening said left side of said chest portion to said right side, said fastening means comprising a hook and loop fastening means comprising a hook portion and loop portion, said hook portion being securely attached to an inside surface of said right side, said loop portion being securely attached to an outer surface of said left side.

7. A vest and backpack combination device, comprising:

a vest having a chest portion, a pair of side portions, a back portion and a pair of shoulder straps, said chest portion being divided into a left side and right side, said back portion comprising an inner panel and an outer panel coupled together such that a space is defined between said inside and outer panels, said outer panel having at least one opening therein extending into said space, said front and back side portions each having an outer surface being formed of a generally reflective material;

a closing means for selectively closing of said opening;

a fastening means for releasably fastening said left side of said chest portion to said right side;

wherein said vest forms a plurality of compartments, a first one of said compartment being located adjacent to and rearward of the inner panel of said vest, and a second one of said compartments being located directly rearward of said first compartment and forward of said outer panel, an intermediate wall being positioned between said first and second compartments, said opening being in communication with said first compartment.

8. The vest and backpack combination device as in claim 7, wherein said plurality of compartments includes a third compartment located rearwardly of said second compartment such that said second compartment is located between said first compartment and said third compartment, said third compartment being located rearwardly of said outer panel.

9. The vest and backpack combination device as in claim 7, wherein a slit in said outer wall defines a flap portion of said outer wall to provide access to said second compartment, a second closing means for selectively closing said slit.

10. The vest and backpack combination device as in claim 9, wherein said slit is substantially U-shaped and is oriented in an inverted position.

11. The vest and backpack combination device as in claim 9, wherein the plurality of compartments comprises a third compartment, said third compartment being located on said flap portion of said outer wall.

12. The vest and backpack combination device as in claim 7, wherein said opening is defined by a slit formed in an upper portion of said outer panel.

13. The vest and backpack combination device as in claim 12, wherein the slit defining said opening is substantially U-shaped.

14. The vest and backpack combination device as in claim 7, wherein a layer of compressible material is positioned between said inner panel.

15. A vest and backpack combination device, comprising:

a vest having a chest portion, a pair of side portions, a back portion and a pair of shoulder straps, said chest portion being divided into a left side and right side, said back portion comprising an inner panel and an outer panel coupled together such that a space is defined between said inside and outer panels, said outer panel having at least one opening therein extending into said space, said front and back side portions each having an outer surface being formed of a generally reflective material;

a closing means for selectively closing of said opening;

a fastening means for releasably fastening said left side of said chest portion to said right side;

wherein said vest forms a plurality of compartments, a first one of said compartment being located adjacent to and rearward of the inner panel of said vest, and a second one of said compartments being located directly rearward of said first compartment and forward of said outer panel, an intermediate wall being positioned between said first and second compartments, said opening being in communication with said first compartment;

wherein said plurality of compartments includes a third compartment located rearwardly of said second compartment such that said second compartment is located between said first compartment and said third compartment, said third compartment being located rearwardly of said outer panel;

wherein a slit in said outer wall defines a flap portion of said outer wall to provide access to said second compartment, a second closing means for selectively closing said slit, said slit being substantially U-shaped and is oriented in an inverted position;

wherein said third compartment is located on said flap portion of said outer wall;

wherein said opening is defined by a slit formed in an upper portion of said outer panel, the slit defining said opening being substantially U-shaped; and wherein a layer of compressible material is positioned between said inner panel.

* * * * *